United States Patent [19]

Friel

[11] Patent Number: 5,005,319

[45] Date of Patent: Apr. 9, 1991

[54] KNIFE SHARPENER

[75] Inventor: Daniel D. Friel, Greenville, Del.

[73] Assignee: Edgecraft Corporation, Wilmington, Del.

[21] Appl. No.: 396,974

[22] Filed: Aug. 22, 1989

Related U.S. Application Data

[63] Continuation-in-part of Ser. No. 304,323, Jan. 31, 1989, Pat. No. 4,897,965, which is a continuation-in-part of Ser. No. 917,601, Oct. 6, 1986, Pat. No. 4,807,399, which is a continuation-in-part of Ser. No. 588,794, Mar. 12, 1984, Pat. No. 4,627,194, and Ser. No. 855,147, Apr. 23, 1986, Pat. No. 4,716,689, which is a continuation-in-part of Ser. No. 588,795, Mar. 12, 1984, abandoned.

[51] Int. Cl.[5] ..... B24B 3/54; B24B 1/00

[52] U.S. Cl. ..... 51/58; 51/109 BS; 51/3; 51/119; 51/285; 51/326; 51/170 MT

[58] Field of Search ..... 51/109 BS, 116, 3 R, 51/119, 128, 205 WG, 285, 210, 326, 57-60, 108 BS, 102, 6, 208, 214, 241 G, 121 MT, 221 BS

[56] References Cited

U.S. PATENT DOCUMENTS

| | | | |
|---|---|---|---|
| 2,412,141 | 12/1946 | Ford | 51/119 |
| 2,787,100 | 4/1957 | Peyches | 51/119 |
| 3,071,899 | 1/1963 | Hicks et al. | 51/128 |
| 3,332,173 | 7/1967 | McMaster et al. | 51/128 |
| 3,844,067 | 10/1974 | Guerra et al. | 51/109 BS |
| 4,532,736 | 8/1985 | Shinneman, Jr. et al. | 51/221 BS |

*Primary Examiner*—D. S. Meislin

*Attorney, Agent, or Firm*—Connolly & Hutz

[57] ABSTRACT

A knife sharpener includes a sharpening member having a flat outer face with abrasive particles mounted thereon. The sharpening member is orbitally driven to impart an orbital motion to each of the particles of no greater than ⅜ inch effective diameter and an orbital velocity of no greater than 1500 feet per minute.

14 Claims, 3 Drawing Sheets

Fig. 4.
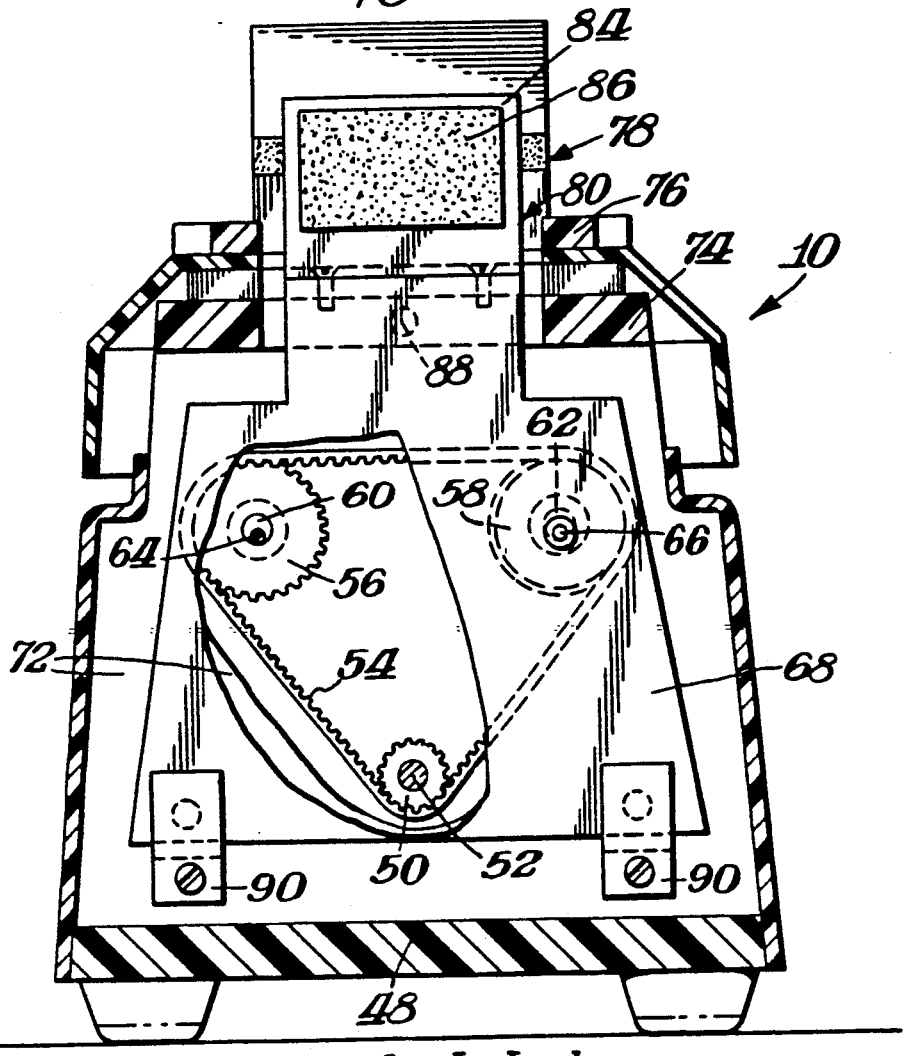
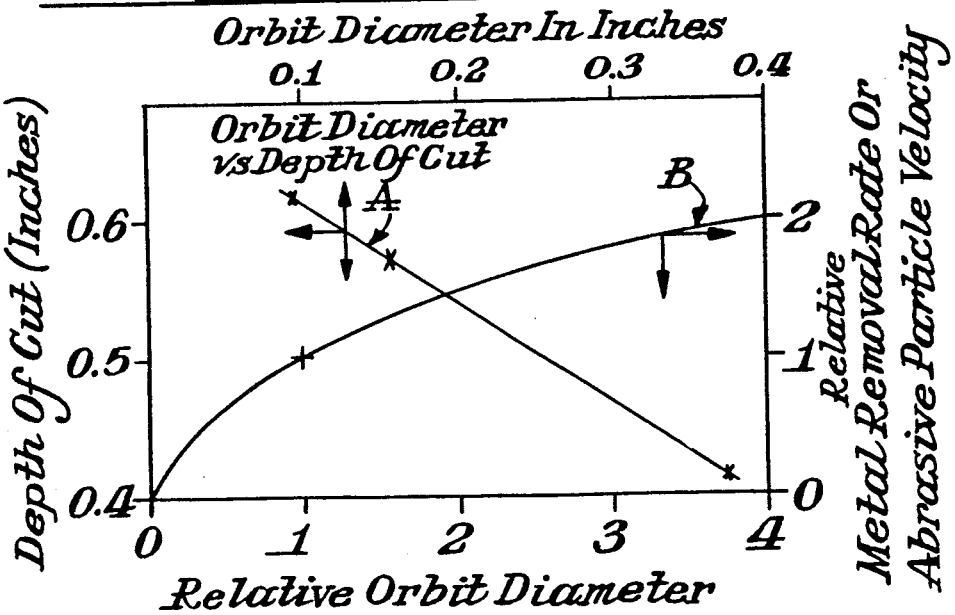
Fig. 5.

KNIFE SHARPENER

CROSS-REFERENCE TO RELATED APPLICATIONS

This application is a continuation-in-part of application Ser. No. 304,323 filed Jan. 31, 1989, now U.S. Pat. No. 4,897,965 which in turn is a continuation-in-part of application Ser. No. 917,601 filed Oct. 6, 1986, now U.S. Pat. No. 4,807,399 which in turn is a continuation-in-part of application Ser. No. 588,794 filed Mar. 12, 1984, now U.S. Pat. No. 4,627,194 and Ser. No. 855,147 filed Apr. 23, 1986, now U.S. Pat. No. 4,716,689, which in turn is also a continuation-in-part of Ser. No. 588,795 filed Mar. 12, 1984, now abandoned.

BACKGROUND OF DISCLOSURE

This application relates to a knife sharpener and a method of sharpening knives. The above noted parent applications describe in detail such a knife sharpener which has been found to be particularly effective. Such sharpener includes a pre-sharpening section and two honing sections. A rotatably mounted disk having abrasive particles thereon is used in the pre-sharpening section, while each honing section includes a sharpening member having abrasive particles wherein the sharpening member is orbitally driven. The present invention is directed to the honing sections with respect to the orbitally driven sharpening members.

SUMMARY OF INVENTION

An object of this invention is to provide a knife sharpener and method of sharpening a knife in accordance with the above indicated applications.

A further object of this invention is to provide such a knife sharpener wherein the sharpening member is orbitally driven.

In accordance with this invention the orbital motion of each abrasive particle on the sharpening member is limited to no more than 800 feet per minute and ±0.005 inches in a direction perpendicular to the plane of the abrasive surface and has an orbital length per revolution for each abrasive particle of less than about 1 inch. In a preferred practice of the invention, the orbital motion is such that the abrasive particles have a velocity of no greater than 1500 feet per minute and a motion of no greater than ⅜ inch effective diameter.

THE DRAWINGS

FIG. 4 is a cross-sectional view taken through FIG. 3 along the line 4—4;

FIG. 5 is a chart comparing the metal removal rate and knife edge cutting effectiveness as a function of orbital diameter;

Figure 7A:
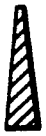

FIGS. 6 A, B and C schematically shown in elevation the effect of sharpening with particles moving perpendicular to an edge respectively before sharpening, after sharpening one edge and after sharpening both edges with the resulting teeth which are weak and fail rapidly;

FIGS. 7A and B schematically show in plan view an edge before sharpening and after machining, respectively, to show the effect of particles moving parallel to an edge; and FIG. 8 is a plan view schematically showing the movement of an orbiting particle with respect to the cutting edge facet of a knife.

DETAILED DESCRIPTION

The present invention utilizes the teachings of the above-noted applications, the details of which are incorporated herein by reference thereto. To avoid repetition the present description will be directed to certain aspects of the orbital drive for the honing sections. Other features such as the magnetic guides will be referred to only in general terms.

Figure 1:
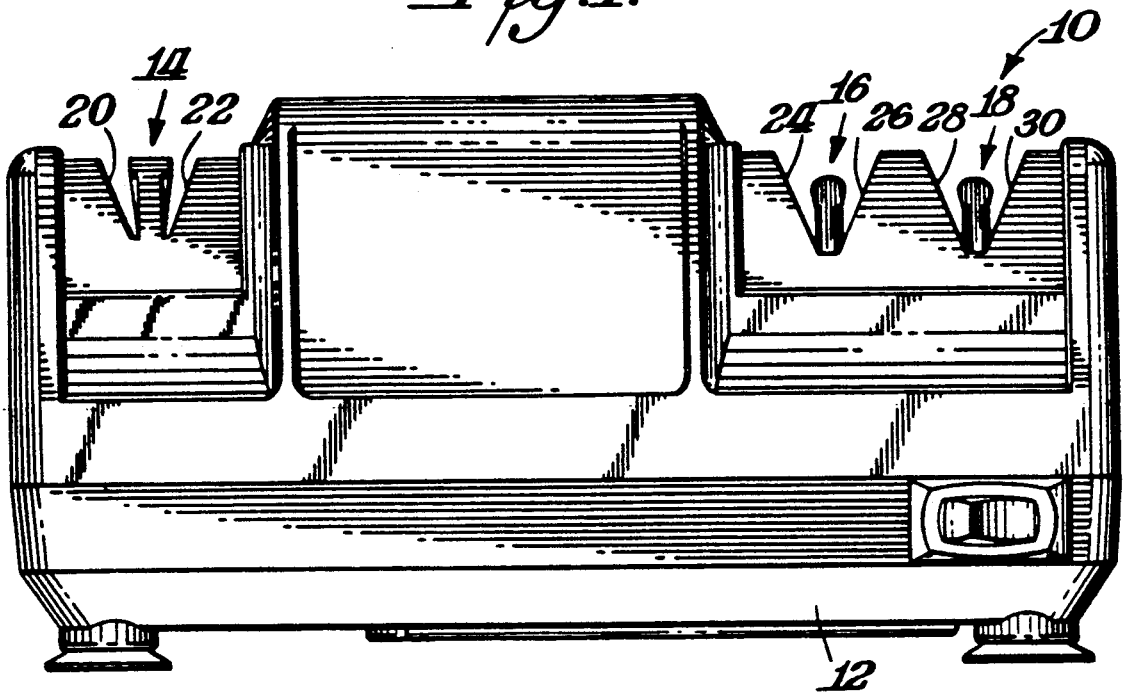
FIG. 1 is a side elevation view of a knife sharpener in accordance with this invention.

FIG. 1 shows a knife sharpener 10 in accordance with this invention. Sharpener 10 includes a housing 12 in which are provided a pre-sharpening section 14, a first honing section 16 and a final honing section 18. Each of these sections includes a pair of slots with an exposed abrasive surface being provided at each slot. Additionally guide means, preferably the magnetic guides described in the parent applications, disposes the knife edge or cutting facet at a predetermined angle with the angles of each section differing. The guides of the two sets of guide means in each section are disposed at mirror image angles to each other and progressively increase the total angle of the cutting facet from, for example, 40° in the pre-sharpening section 14, to 45° in honing section 16 and finally to 50° in honing section 18.

In operation the user would first place the knife in a slot 20 in pre-sharpening section 14. After passing the knife through either slot 20 or slot 22 a suitable number of times, the procedure would be repeated in the other slot. This results in removing the old edge of the knife and creating the first edge angle. The knife edge would then be honed at a second angle by passing through slots 24, 26 in honing section 16. Finally, the knife edge would be honed or polished to its final angle by passing through slots 28, 30 in honing section 18.

Figure 2:
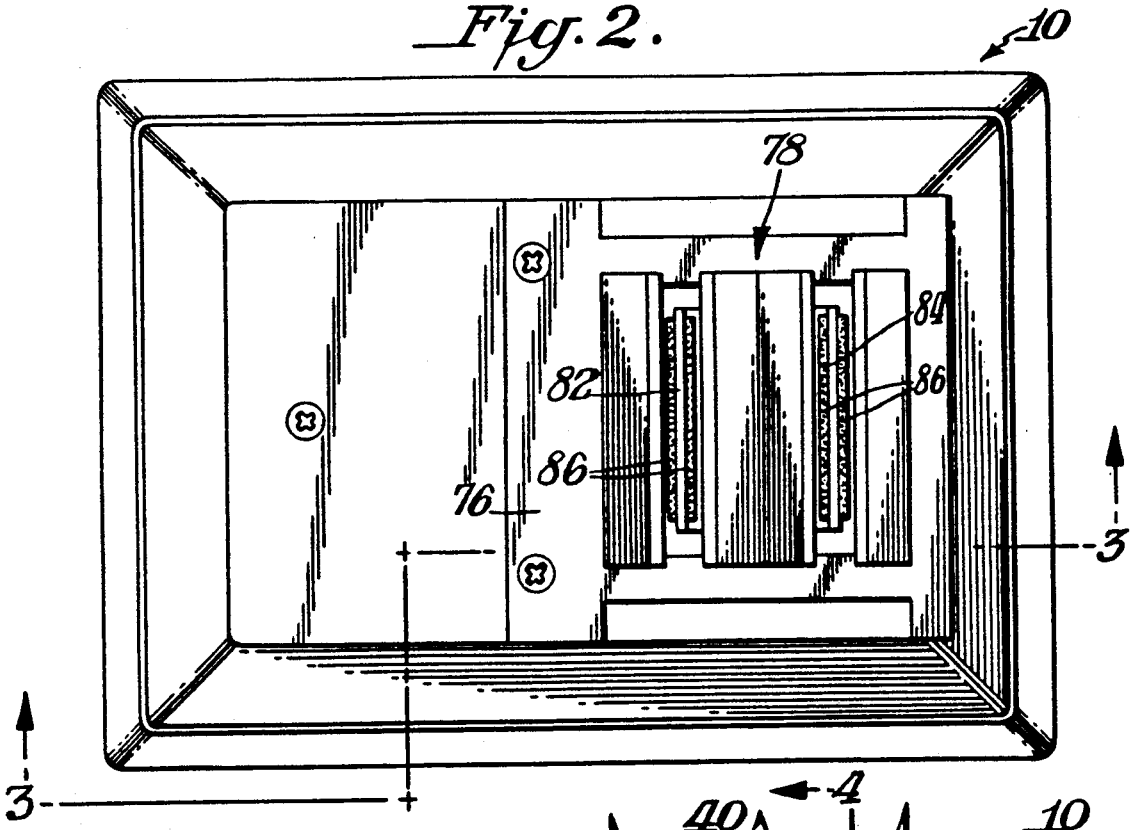
FIG. 2 is a top plan view of a honing section of a knife sharpener in accordance with this invention.
Figure 3:
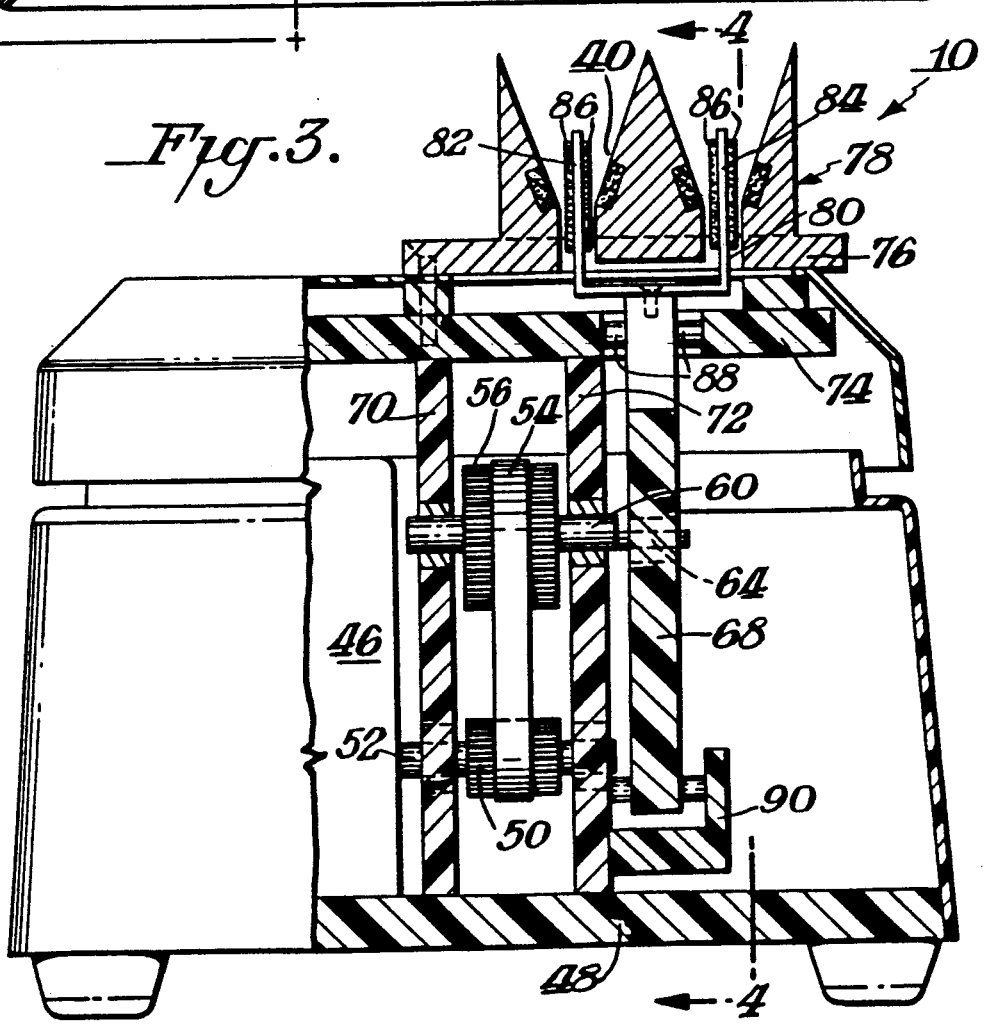
FIG. 3 is a cross-sectional view taken through FIG. 2 along the line 2—2.

FIGS. 2–4 show a honing section which may used alone or incorporated in sharpener 10, in which the orbiting abrasive surfaces move in a vertical plane. In this embodiment, a motor 46 of FIG. 3 is mounted on base plate 48 and drives a gear pulley 50 mounted on motor shaft 52. Timing belt 54 driven by gear pulley 50 drives gear pulleys 56 and 58 mounted on horizontal drive shafts 60 and 62 whose ends are machined to form drive cranks 64 and 66. The drive cranks 64 and 66 driven synchronously by this belt-gear pulley arrangement engage into crank bearings mounted in an orbiting drive plate 68 so that orbiting drive plate 68 is driven in an orbital path. Vertical support plates 70 and 72, FIG. 3, mounted on the base plate 48 provide support and alignment for motor shafts 52 and drive shafts 60 and 62, and support for upper plate 74 and guide support plate 76, that in turn supports a knife-guide assembly 78, of the type described in the parent applications. Bearings mounted in vertical plate 70 for the other end of drive shafts 60 and 62. A motor shaft bearing provides support for the end of motor shaft 52. It is mounted in vertical support plate 72. Orbiting drive plate 68 supports a yoke 80 made of metal or plastic whose upper arms 82 and 84 serve as mounting supports for diamond abrasive materials 86 that orbits within the stationary knife guide assembly 78.

Orbiting drive plate 58 is held in position by at least three pairs of support bearings 88, with pair members positioned on either side of orbiting drive plate 68 in slidingly contact with orbiting drive plate 68 and held in place by upper plate 74 and by lower bracket 90 fastened to vertical support plate 72 by adhesive or suitable screws, not shown. This maintains at all times a three point supporting means for orbiting drive plate 68. In an acceptable alternative arrangement, not shown, the support bearings 88 could be affixed to the orbiting drive plate 68 and rest in slidingly contact with upper plate 74 and lower bracket 90.

Means are provided through a contact adhesive or other arrangement for removal and replacement of individual abrasive material 86 and/or for replacement of all abrasive materials 86 simultaneously with their supporting yoke 76 by means of screws or other devices. At any time during sharpening, there is a small clearance on the order of 0.001 inch between certain of the support bearings 88 and the orbiting drive plate 68 but in use there is also actual contact between the orbiting drive plate 68 and three of the support bearings 88 depending on the direction of force of the knife against the abrasive material 86. At any time the orbiting drive plate is forced to cycle in one of several closely spaced planes established by the support bearings and the spacing between these bearings in slidingly contact with the plate. In this manner very positive support is provided at all times that stabilizes the plane of the orbiting drive plate 68 and the attached abrasive material 86. With this unique contact support means, there is no need for restraining springs or the like that would otherwise introduce greater frictional force on the face of support bearings 88 and increase the power requirements for the drive means.

Where there is some twisting force on the orbiting drive plate 68, FIG. 3, caused by the sharpening action, more than the six support bearings 88 may be desirable. However, when sharpening normally not more than three are being used at any instant in time The crank bearings, motor shaft bearing and shaft bearings support the end of motor shaft 52, eccentric cranks 64 and 66, and the drive shafts 60 and 62. These bearings can be eliminated if vertical support plates 70 and 72 and the orbiting drive plate 68 are made of a material such as a high temperature glass-filled polyester or other material that can serve both as a rugged structural material and as a bearing material. Any knife guide assembly 78 used with this sharpener should be supported through the guide support plate 76 onto upper plate 74, FIG. 3 and FIG. 4, or other rigidly attached member such as vertical support plate 72 that also provides direct or indirect support for the support bearings 88 that establish the position of the orbiting drive plate 68. In this manner any major vibrations of the mechanical supporting structure incorporating members 72, 70 and 74 affect alike the knife guide assembly 78 and the orbiting components including 68, 80, 82, 84 and abrasives 86. By this means the relative motion between the knife guide assembly 78 and the orbiting abrasive material 86 is minimized as caused by vibrations and movements of those major structural parts held together by structural adhesive or screws.

Applicant has discovered that there is an optimum range of the effective orbit-diameter determined by metal removal rates and quality of the final knife edge. It was surprising to discover, as shown in curve A of FIG. 5, that as the orbital diameter is reduced the quality of the edge, i.e. the cutting ability of the resulting knife edge, improves. However, as the diameter of the orbit or the velocity of the diamond particles is reduced the metal removal rate and sharpening rate is reduced. Obviously at zero diameter orbit the velocity of diamond particles relative to the knife is zero and no sharpening occurs. These effects are shown graphically in FIG. 5, as later described.

It has been found that a high enough velocity can be achieved for a practical metal removal rate using diamonds as the abrasive at linear speeds as low as 15 or 20 feet/minute (orbiting). At velocities about 1500 feet/minute there is danger of overheating the fine knife edge being formed-thereby losing its hardness (temper).

At a diamond velocity of 1500 feet/minute (orbiting) the design of an unsecured (i.e. not fastened down) sharpener is difficult for mechanical reasons. The apparatus at this speed should be clamped down or it may "walk" around the table.

The invention is practiced optionally with an orbital drive wherein the motion to each abrasive element is limited to 800 feet/minute and ±0.005 inches in a direction perpendicular to the principle plane (plane of the abrasive surface) and has an orbital length per revolution for each abrasive element of less than about one-inch.

Considering the mechanical stability of the sharpener it was found possible to maintain a constant level of stability with a larger orbit, if at the larger orbit the RPM is reduced approximately by the square root of the increase in orbit size, as shown in curve B of FIG. 5. This means if the diameter is increased by a factor of 4, the RPM must be reduced by about ½. This also means if the orbital diameter goes up by 4, for example, the diamond particles velocity may increase only about 2 fold-to maintain the same stability as reflected in curve B of FIG. 5.

For reasons of edge quality (knife cutting ability) and reasonable sharpening rates, but limited by overheating of the edge at velocities about 1500 feet/minute and by mechanical instabilities of the sharpener, it has been found surprisingly that the acceptable operating ranges for superior edge quality is well defined and relatively narrow with an effective orbital diameter ⅜" and with practical diamond particle velocities in the range of about 15 to 1500 feet/minute. The orbit can be somewhat elliptical without a detrimental effect on the perfection of the edge being formed so long as the effective diameter, defined as particle path length divided by pi, remains in the range previously noted.

The cutting ability of knife edges produced with final orbit sizes of 0.094", 0.156", and 0.375" (600 grit) was. determined experimentally by measuring the depth of cut made by one stroke of the weighted knife into the edge of a cardboard sheet as follows:

| Orbit Diameter Used (inches) | Average Depth of Cut in Cardboard (inches) |
|---|---|
| 0.094" | 0.617" |
| 0.156" | 0.570" |
| 0.375" | 0.415" |

The results of these tests are shown in FIG. 5 where line A plots orbit diameter versus depth of cut. Line B represents the relative metal removal rate as related to the relative orbit diameter, at constant mechanical stability of the sharpener. The knife edges were produced at an orbiting speed of 1,500 rpm using an abrasive grit size of 600 with the knife blade edge formed at a total angle of about 50°.

As can be appreciated, the present invention thus not only provides for orbital drive in honing sections 16 and 18, but also teaches an optimal size range and velocity of orbital motion.

The present invention departs from prior art practices by the following features:

1. Use of small orbits as the predominant motion for knife sharpening. Use of large orbits is old and as applicant has discovered is less effective for precision edge formation. Orbital motions are used for a variety of other purposes.

2. Use of planer abrasives with fixed (not loose) particles in orbital motion for knife sharpening.

3. Non-conventional manually "operated" knife holder that permits manual movement of the blade through the sharpener while avoiding manual "interference with" or "influence over" the sharpening angle while sharpening. The invention utilizes the combination of:

a. small orbits to realize edge perfection and machine stability b. planer abrasive surface c. fixed abrasive particles d. highly stable orbiting plane e. means to support knife in stable position. Knife must not vibrate relative to abrasive surface f. control of angle must be independent of human influence g. highly reproducible knife position (stroke to stroke reproducibility)

Small orbital movement is known in the prior art with respect, for example, to abrading sheet glass. Such a teaching is had in U.S. Pat. No. 2,787,100 (Peyches). The abrading of sheet glass, however, is quite distinct from sharpening the edge of a metal knife. In seeking perfection of the face of a polished sheet, the quality of the edge of that sheet is of no real concern or interest The quality of the edge can be and usually is very poor as compared to the quality of a well sharpened knife edge. The distinctiveness of these two different applications is evident from the following.

Glass is a brittle crystalline-like material that is polished by a microfracturing process. High local stresses are created that result in chipping-out of small glass particles. This is a little like the stone mason's task of shaping a stone by chiseling out pieces that break off by a fracturing process. Glass will rupture (chip) with pressure of only 500–1000 p.s.i.

Steel is a ductile material which can not be fractured like glass and removed by a chipping out process Steel can be removed only by a micromachining process—a gouging or shaving operation. Sharpening is a direct analog of drilling, lathe, or milling operations that remove shavings. It has been found with applicant's sharpener that the microshavings removed are micropigtails like the shavings described above Steel elongates before rupture allowing a machining quality.

The difference between glass and steel is more pronounced when it comes to producing edges High stress methods such as applicant uses on steel with diamond particles would chip-out glass edges leaving a very ragged unacceptable edge. That simply would not work. The common method of creating a cutting edge on glass is to make a clean break fracture of a very thick slab of glass and to use the resulting sharp edge as a knife.

Materials used to grind and polish glass such as sand and iron oxides can be used to remove metal but the process is inefficient and the metal is caused to flow and is "smeared off". This process generates high heat and will "burn" the steel taking out its temper. In other words this process softens the steel and reduces the edgeholding quality of the blade. Applicant has overcome this by using diamonds that are so hard that they will machine steel cleanly without generating such heat. Sand and iron oxide work well on the other hand to create stress points to chip glass. Iron oxide is almost never used for serious metal removal. Diamonds used with the unit pressures employed by applicant for knife sharpening would be too aggressive for glass and cause excessively rapid chipping, preventing good edge formation.

Since steel edges can not be formed by chipping, it is unreasonable to assume that glass technology can be transferred to formation of metal edges If the orbiting method of this invention were at all obvious for steel edges, clearly it would have been picked up by razor and scalpel manufacturers; while in fact they have not in all these years discovered the value of small orbits for steel edge formation. They continue to use essentially linear across-the edge motions and techniques. The edges created by applicant are twice as sharp as razor blades or said differently the force required to cut with applicant's edges is half that required with commercial razor blades. Razor manufacturers have gone to great lengths to get sharper and longer lasting edges including techniques such as honing and coating with platinum and Teflon® to mention a few. That is a very competitive business, yet no one had discovered the technology herein which yields not only sharper (2X) but longer lasting edges (3X).

Peyches technology pertains only to polishing of glass and not to knife sharpening. The disclosure in Peyches of particular orbital size and speeds is not suggestive of using those parameters for edge formation or knife sharpening.

Peyches teaches use of loose abrasives (wet or dry). Applicant has found that loose abrasive systems do not give a good edge on steel because of "balling" and agglomerate formations that create gouging. Peyches in fact alludes to such problems column 7, lines 0-10. Peyches had to use a secondary alternating or reciprocation motion across the glass plate in a direction transverse to movement of the sheet to overcome this problem; this motion was needed in addition to the "homocircular" motion. Applicant uses only immobilized fixed particles physically attached to a supporting plate.

The differences between Peyches and the present invention are exemplified by the optimum orbit size. The invention uses a maximum orbit size to be ⅜ inch which is 0.95 cm. The optimum orbit size would thus always be less than 0.95 cm. In contrast Peyches found the optimum orbit size for glass to be in the 1–4 cm range when using 50–60 size loose grit. For dry grit Peyches found the optimum orbit size to be 1 cm which is greater than the upper limit orbit size of applicant.

The optimum orbit size found by applicant in all cases was less than 0.95 cm based on sharpness of edge and relative removal rate. Applicant found unlike glass that the smaller the orbit the better were the results for all grits tested. Applicant did not find a specific single optimum orbit size such as Peyches reports. This is understandable as the material removal processes are radically different. In the eyes of material and engineering specialists these are directly opposed mechanisms. Applicant's standard orbit size is 0.092 inches which is 0.23 centimeters, the upper limit is set by mechanical considerations unlike the glass case. With glass one is dealing with fracture rates. With knives and steel one is dealing with machining rates and machining perfection—a different game.

Peyches used a very wobbly abrasive pad with little angular control. This mechanism would be unsatisfactory for sharpening of edges because of the poor angular control. The beam used by Peyches is free to move angularly and laterally, being restrained only by springs. Also Peyches does not suggest any means for mounting or holding anything other than a flat plate. Clearly the mechanism would be inapplicable for faceted knives.

Peyches teaches use of an orbit or "about 1 cm" for dry adhesives (See claim 5). That is equivalent to 0.394"which is greater than applicant's top orbit diameter limit of 0.375". Applicant's range starts at this value and goes down in size. Applicant uses only dry abrasives. All of Peyches abrasives are loose. Applicant's abrasives are tightly bound.

The polishing of glass with loose abrasives is a process known as three-body abrasion—that is, the glass, the abrasive grain, and the tool. In the abrasive removal of brittle material, one depends upon sharp points on the abrasive particles to spall out fracture chips. It is well known in grinding wheel technology that wheels will dull and cease to remove material if the work pressure is not sufficient to fracture the abrasive grains and expose new sharp points. This is true even of wheels made of aluminum oxide or silicon carbide, both of which are far harder than silica sand.

The same is true in the polishing of brittle materials like glass. For example, L.E. Samuels ("Metallographic Polishing by Mechanical Methods", Chap. 7, "Brittle Materials: Principles", 3rd Ed., American Society for Metals, 1982.) in discussing the polishing of glass states "In three-body abrasion, sharp rolling abrasive particles have produced large randomly arranged pits (FIG. 7.4*c*) whereas blunt particles have produced randomly arranged sets of ring cracks (FIG. 7.4*d*). The sharp abrasive has removed considerable amounts of materials whereas the blunt abrasive has removed virtually none under these particular circumstances."

Samuels also points out the essential use of water in polishing glass. "The surface of glass polished in the presence of water always contains a layer of hydrated material, and the formation and presence of this layer is generally thought to play a significant role in the polishing process. The polishing rate is certainly greatly influenced by the hydroxyl activity of the polishing fluid, the reactivity of the abrasive and the reactivity of the glass."

Thus, in the polishing of glass with loose sand abrasive grains, if the grains are rolled in a straight line or reciprocating motion between the glass and the tool, only the points which lie in one equatorial plane (that plane perpendicular to the glass surface and parallel to the direction of motion) will be active, and they will rapidly dull and cease to be effective. So the function of the orbital motion described by Peyches is to change the direction of the motion and thereby change the active equatorial plane, exposing new sharp points for fracturing the glass surface. Clearly using a large orbital diameter with a small grain approaches straight line motion. It is not surprising, therefore, that for polishing the surface of a glass sheet as Peyches found, the orbital diameter must decrease as grain size decreases.

On the other hand, placing an edge on a ductile metal knife blade with an orbiting flat surface containing embedded fixed diamond abrasives is a two-body abrasive process—the flank surface (facet) of the blade and the abrasive. The objective is to flatten each flank surface and move them together at a constant angle between them so that eventually they meet in a straight line to form an infinitely sharp edge. Fluids are unnecessary.

It is well known in tribology that the processes that occur in two-body phenomena consist of plowing out a microchip, just as in cutting on a lathe, plowing a groove, and displacing the plowed material to form adjacent ridges. If one moves the abrasive in only one direction or in reciprocating motion, a rippled surface of parallel groves and ridges will be produced. Obviously, two rippled surfaces will not intersect in a straight line to give a geometrically perfect edge.

Applicant's invention is based on recognition that by producing random groove and ridge directions by using orbital motion of the abrasive and linear motion of the blade, a finer line of intersection is obtained. This is confirmed by the fact that the highest quality commercial knives and razor blades can be made much sharper by using orbital motion after the standard finishing by straight line honing.

Applicant also found that edge quality improves as the orbital size decreases but, in contrast to Peyches, this has nothing to do with exposing new sharp cutting points because applicant's diamonds stay sharp The improvement results because the more rapidly changing direction of the abrasives causes the ridges to be cut off almost as they form while new groove formation is suppressed. In addition, the chip cut from the ridge will be wiped off by the change in direction before it accumulates a large amount of metal and interferes with the polishing process. Of course, the rate of metal removal decreases with decreasing orbital size as the rate must go to zero at zero size. So the optimum orbital size range is a compromise between wanting the smallest for best edge quality and the largest mechanically feasible for fastest sharpening.

Figure 6A:
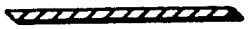
Figure 6B:
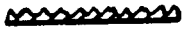
Figure 6C:
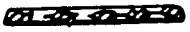

The present invention resulted from the discovery that a special orbital motion of fixed abrasive particles in contact with metal knives can create edges of great perfection. Experiments with abrasive particles orbiting over a range of radii demonstrated the advantage of using an orbit of small radius. As the radius is increased the particle motion becomes more linear, and it was found that the resulting edge became more ragged. It was shown that particles moving only perpendicular to an edge will machine grooves across the edge as shown in FIGS. 6A–6C leaving a tooth-like structure along the edge The resulting tooth-like edge is weak and fails rapidly in use.

Figure 7B:
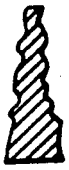
Figure 7C:
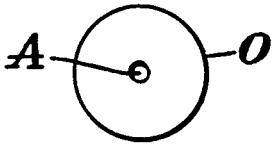

Particles moving only parallel to an edge will machine grooves parallel to the edge and leave any of several edge shapes including those shown in FIGS. 7A and 7B. Most of the resulting edges created by the motion of abrasives parallel to the edge are weak because of the under-cutting action adjacent to the edge Long slivers of metal created along the edges are weak and easily fail in use.

Using an orbital motion of small radius for sharpening, any point along the edge will experience only a brief encounter with abrasive particles briefly at a multiplicity of angles to the line of the edge, followed by a particle moving parallel to the edge The result of these successive and repetitive actions is to remove a plane of material of uniform depth. Imagine, as in FIG. 8, a small circular area on one facet of the two facets that meet to form the edge where the area A shown is smaller than the diameter of the orbit 0, and the abrasive particles are small compared to that area Abrasives will cross the small area from every direction removing material uniformly across the area Since in practice the orbiting abrasives will cross each point along the facet, material is removed uniformly along each facet with a minimum of residual grooving. Any residual grooving is largely the result of the last motion before the edge is removed or the abrasive stops, and if the orbital diameter is small, the damage to the edge, if any on stopping, is small. By contrast using only a linear motion, the abrasive will create deep residual linear grooves in the surface and through the edge.

Brittle materials such as glass can be polished mechanically only by a fracturing process—not by machining. In the fracturing process loose abrasive particles are pressed against the glass surface by a weighted plate to form high localized pressure points that cause the glass to fracture locally under the load and chip out, pit, or spall. Hard brittle materials cannot be machined like metals that are ductile and will flow under load. Instead brittle material like glass can be removed only by chipping.

It would seem that techniques used to smooth the surface of glass can be used to form edges on glass. In fact, attempts to form sharp edges by applying forces along the edge of glass or other brittle materials serve only to create uncontrolled chipping and leave a very rough edge, as in the ubiquitous arrow heads used by early man. The only known means to create a good sharp edge on a piece of glass, albeit short and irregular, is to fracture a homogeneous thick piece of glass. Attempts to sharpen the edge of a piece of glass using fixed abrasives, such as on diamond wheels, lead only to severe chipping and an extremely irregular "edge". Applicant has found repeatedly the impracticability of sharpening an edge on a piece of glass with orbiting abrasives affixed to a rigid substance. Even extremely low pressures applied along the edge of brittle materials causes chipping and ragged edges unsuitable for use as a modern knife. Applicant found that using only the lightest pressures with a fixed abrasive wheel, the thickness of the edge and irregularity along a glass edge could not be reduced to a size smaller than the size of the particles, while for steel knives, the machined irregularities along the edge were on the order of 1/100 the particle size.

The mechanisms of material removal for glass and steel are vastly different and their techniques are not readily transferable from one art to another. Glass cannot be removed by machining and metals cannot be removed and shaped successfully by chipping. The techniques for forming edges on steel are totally unworkable on brittle glass-like material. Similarly, the fracture techniques useful on glass-like materials to form edges are totally unworkable on metal knives.

With force from an abrasive particle, the brittle material being abraded will crack and fracture under the applied load. Vent cracks form and allow chipping to occur. Such chipping ruins an edge if one is attempting to form an edge. On a flat surface remote from the edge the chipping does not create a problem if one is trying to polish the surface. With a sliding indenter on glass more material is removed than the volume swept out of the surface by the indenting point. The volume difference is by an order of magnitude. The material so removed called a fracture chip, is distinct from a machining chip and is the mechanism responsible for abrasion of brittle material.

What is claimed is:

1. A knife sharpening apparatus comprising a housing, a honing section in said housing, a sharpening member in said honing section, said sharpening member having a flat outer face with abrasive particles mounted thereon, guide means in said honing section at a non-parallel and non-perpendicular angle to said flat outer face for disposing the face of a knife against said guide means with the cutting edge facet of the knife against said sharpening member parallel to said flat outer face, drive means for orbitally driving said sharpening member, and said drive means imparting an orbital motion to each of said particles of no greater than ⅜ inch effective diameter and an orbital velocity of no greater than 1500 feet/minute.

2. The apparatus of claim 1 wherein said abrasive particles are diamond particles with generally flat surfaces.

3. The apparatus of claim 1 wherein said drive means imparts an orbital velocity which is between about 15 to 1500 feet/minute.

4. The apparatus of claim 1 wherein said drive means imparts an orbital velocity of no greater than 800 feet/-minute.

5. The apparatus of claim 1 wherein said sharpening member has a flat outer face on each side thereof with abrasive particles mounted thereon.

6. The apparatus of claim 5 wherein said honing section is a first honing section, and a second honing section in said housing identical to said first honing section except for said guide means of said first honing section being at a different angle than said guide means of said second honing section.

7. A knife sharpening apparatus comprising a housing, a honing section in said housing, a sharpening member in said honing section, said sharpening member having a flat outer face with abrasive particles mounted thereon, guide means in said honing section at a non-parallel and non-perpendicular angle to said outer face for disposing the face of a knife at an angle and the cutting edge facet of the knife against said sharpening member parallel to said flat outer face, drive means orbitally driving said sharpening member, and said drive means imparting a velocity to each of said abrasive particles which is no greater than 800 feet/minute and no greater than ±0.005 inches in a direction perpendicular to said flat outer face and an orbital length per revolution of less than about one inch.

8. The apparatus of claim 7 wherein said abrasive particles are diamond particles with generally flat surfaces, said sharpening member having a flat outer face on each side thereof with abrasive particles mounted thereon, said honing section being a first honing section, and a second honing section in said housing identical to said first honing section except for said guide means of said first honing section being at a different angle than said guide means of said second honing section.

9. In a method of sharpening a knife, the improvement being in placing the knife in a sharpener by guiding the knife against an orbitally driven sharpening member having abrasive particles on its exposed surface, and orbitally driving the sharpening member to impart an orbital motion of no greater than ⅜ inch effective diameter and an orbital velocity of no greater than 1500 feet/minute.

10. The method of claim 9 wherein the sharpening member has abrasive particles on opposite faces thereof, and sequentially placing the knife against each of the faces of the sharpening member.

11. The method of claim 10 wherein the sharpener has two honing sections each with an orbitally driven sharpening member, and sequentially placing the knife against each surface of each sharpening member but at a different angle in each honing section.

12. In a method of sharpening a knife, the improvement being in placing the knife in a sharpener by guiding the knife against an orbitally driven sharpening member having abrasive particles on its exposed surface, and orbitally driving the sharpening member to impart a velocity to each of the abrasive particles which is no greater than 800 feet/minute and no greater than ±0.005 inches in a direction perpendicular to the surface of the sharpening member and an orbital length per revolution of less than about one inch.

13. The method of claim 12 wherein the sharpening member has abrasive particles on opposite faces thereof, and sequentially placing the knife against each of the faces of the sharpening member.

14. The method of claim 13 wherein the sharpener has two honing sections each with an orbitally driven sharpening member, and sequentially placing the knife against each surface of each sharpening member but at a different angle in each honing section.

* * * * *